US006595789B2

(12) United States Patent
Oota et al.

(10) Patent No.: US 6,595,789 B2
(45) Date of Patent: Jul. 22, 2003

(54) ELECTRONIC UNIT, SHIELD CABLE CONNECTING STRUCTURE, CONNECTING METHOD, WIRES WATERPROOF-CONNECTING STRUCTURE, AND METHOD

(75) Inventors: Kouji Oota, Nagoya (JP); Hiroki Hirai, Nagoya (JP); Yoshihiro Kumazawa, Nagoya (JP); Shigeki Sakai, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/977,955

(22) Filed: Oct. 17, 2001

(65) Prior Publication Data

US 2002/0048994 A1 Apr. 25, 2002

(30) Foreign Application Priority Data

Oct. 20, 2000 (JP) ..... 2000-321136
Feb. 7, 2001 (JP) ..... 2001-031121

(51) Int. Cl.[7] ..... H01R 4/66; H01R 13/648
(52) U.S. Cl. ..... 439/98; 439/607; 174/65 R
(58) Field of Search ..... 439/607, 610, 439/98; 174/65 R, 78, 75 C, 74 R

(56) References Cited

U.S. PATENT DOCUMENTS 4,103,101 A * 7/1978 Maier ..... 174/65 R
4,293,151 A * 10/1981 Manzel ..... 174/65 R
4,786,260 A * 11/1988 Spaulding ..... 439/607
5,912,431 A * 6/1999 Sheehan ..... 174/65 R
6,042,396 A * 3/2000 Endo et al. ..... 439/98
6,043,432 A * 3/2000 Gretz ..... 174/65 R
6,231,374 B1 * 5/2001 Kuo ..... 439/455
6,354,851 B1 * 3/2002 Bachle ..... 439/98
6,437,245 B1 * 8/2002 Hayashi ..... 174/74 R

FOREIGN PATENT DOCUMENTS

JP A 2000-215947 8/2000 ..... H01R/13/648

* cited by examiner

*Primary Examiner*—Lynn D. Feild
*Assistant Examiner*—Hae Moon Hyeon
(74) *Attorney, Agent, or Firm*—Oliff & Berridge, PLC

(57) ABSTRACT

Terminal tools 16 are fixed to end portions of a plurality of wires 12 that are covered with a shield lacing 10, and a shield case 30 is connected/fixed to the shield lacing 10. End portions of respective wires 12 are inserted into a unit housing 40 of the electronic unit from the outside and connected to circuits in the unit housing 40, and then connected portions between respective wires 12 and a unit housing 40 are covered with the shield case 30 from the outside by fixing the shield case 30 to an outer surface of the unit housing 40. Also, the shield case 30 and the shield lacing 10 are brought into the state that they can be grounded via the unit housing 40.

4 Claims, 17 Drawing Sheets

ELECTRONIC UNIT, SHIELD CABLE CONNECTING STRUCTURE, CONNECTING METHOD, WIRES WATERPROOF-CONNECTING STRUCTURE, AND METHOD

BACKGROUND OF THE INVENTION

1. Technical Field

The present invention relates to a structure and a method for connecting a shield cable, in which a plurality of wires are covered with a shield lacing, to an electronic unit installed in the vehicle.

Further, the present invention relates to a structure and a method for connecting a plurality of wires to an electronic unit installed in the vehicle in the waterproof condition.

2. Related Art

If the wires must be shielded from other circuits in the situation that the cable is connected electrically to the electronic unit (e.g., the control box of the electric motor) installed in the vehicle, the shield cable is employed as the cable. As the shield cable, the cable in which respective wires are covered with the flexible shield lacing (e.g., copper lacing) is often employed. An example of the method of connecting such shield cable to the electronic unit in the prior art will be explained with reference to FIG. 9 and FIG. 10 hereunder.

1) As shown in FIG. 9, end portions of respective wire 12 are exposed by removing an end portion of the shield lacing 10 by a length L.

2) As shown in FIG. 10, the internal conductors 13 are exposed by stripping off the coating from the end portions of respective wire 12, and then the cylindrical waterproof plugs 14 made of rubber, etc. are fitted at the position located at the back of the exposed portions from the outside. This waterproof plug 14 consists integrally of the press-fitting portion 14*a* with the small diameter, the main body 14*b* with the large diameter, and the flange portion 14*c* with the larger diameter in sequence from the top end side.

3) The terminal tools 16 are fixed to the end portions of respective wires 12. As this terminal tool 16, as shown in FIG. 10, the tool having the ring-like top end portion having the through hole therein, the conductor barrel portion 16*b* formed on the rear side of the top end portion, and the insulation barrel portion 16*c* formed on the rear side of the barrel portion is employed. The conductor barrel portion 14*b* is press-fitted around the internal conductor 13, and the insulation barrel portion 16*c* is press-fitted around the press-fitting portion 14*a* of the waterproof plug 14. Also, as shown in FIG. 9, the ring-like terminal tools 16' is connected/fixed to the end portion of the drain line 15 that is connected to the shield lacing.

4) As shown in FIG. 9, the end portions of respective wires 12 (i.e., the terminal tools 16) are passed through the cylindrical through hole portions 19 provided to the unit housing 18 of the electronic unit, and then the waterproof plugs 14 are press-fitted into the through hole portions 19, whereby the waterproof structure is formed.

5) The terminal tools 16 of respective wires 12 that enter into the unit housing 18 via the through hole portions 19 are connected to the electronic circuit (not shown) housed in the unit housing 18.

6) The vis 22 is passed through the terminal tool 16' that is fixed to the end portion of the drain line 15, and then this vis 22 is screwed into the screwed hole 20 provided to the outer surface of the unit housing 18, whereby the terminal tool 16' is brought into contact with the outer surface of the unit housing 18 and fixed thereto. As a result, the shield lacing 10 can be brought into the state that it can be grounded via the drain line 15, the terminal tool 16', and the outer surface of the unit housing 18.

In the prior art, as the structure for connecting the cable consisting of a plurality of wires to the electronic unit (e.g., the control box of the electric motor) installed in the vehicle in the waterproof condition, the structures shown in FIG. 19 and FIG. 10 are known. The connecting procedures will be given as follows.

1) As shown in FIG. 19, in the shield cable covered with the metal shield lacing 110 having the conductivity, the end portions of respective wires 12 are exposed by removing the end portion of the shield lacing 10 by a length L.

2) As shown in FIG. 10, the internal conductors 13 are exposed by stripping off the coating of the end portions of respective wires 12, and then the cylindrical waterproof plugs 14 made of rubber, or the like are fitted from the outside at the position adjacent directly to the rear side of the exposed conductors 13. This waterproof plug 14 consists integrally of the press-fitting portion 14*a* with the small-diameter, the main body portion 14*b* with the large-diameter, and the flange portion 14*c* with the larger-diameter from its top end side.

3) The terminal tools 16 are fixed to the end portions of respective wires 12. As this terminal tool 16, as shown in FIG. 10, such a tool that has the ring-like top end portion in which the through hole is opened, the conductor barrel portion 16*b* formed at the rear side of the top end portion, and the insulation barrel portion 16*c* formed at the rear side of the barrel portion 16*b* is employed. The conductor barrel portion 16*b* is fitted around the internal conductor 13 by the compression, and also the insulation barrel portion 16*c* is fitted around the press-fitting portion 14*a* of the waterproof plug 14. Also, as shown in FIG. 19, the ring-like terminal tool 16 is connected to the end portion of the drain line 115 connected to the shield lacing 110, and then fixed thereto.

4) As shown in FIG. 19, the end portions of respective wires 12 (i.e., terminal tools 16) are passed through the cylindrical through holes 119 that are provided to the unit housing 118 of the electronic unit, and then the waterproof plugs 14 are press-fitted into the through holes 119, whereby the waterproof structure is constructed into the unit housing 118 via the through holes 119 are connected to the electronic circuit (not shown) housed in the unit housing 118.

6) The vis 122 is passed through the terminal tool 16' fixed to the end portion of the drain line 15 and then screwed into the screwed hole 120 provided on the outer surface of the unit housing 118. Thus, the terminal tool 16' is brought into contact with the outer surface of the unit housing 118 and fixed thereto. As a result, the shield lacing 110 can be grounded via the drain line 15, the terminal tool 16', and the outer surface of the unit housing 118.

Problems to be Solved

In the above structure and method, when the terminal tools 16 are fixed to the end portions of respective wires 12, the end portion of the shield lacing 10 must be removed by the length L in order to expose the end portions of the wires. Therefore, respective wires 12 are not covered with the shield lacing 10 and exposed to the outside in this area of length L, and thus the shielding performance is lowered by such length. Also, in order to ground the shield lacing 10, operations for fixing the grounding terminal tool 16' to the end portion of the drain line 15 separately from the terminal tools 16 and then fixing the terminal tool 16' to the outer surface of the unit housing 18 are needed. Such operations are troublesome and also the connection structure becomes complicated.

Further, in the above structure and method, the operation for press-fitting the waterproof plugs 14 fitted to respective wires 12 into the through holes 119 must be carried out wire by wire. In addition, in order to prevent the waterproof plugs 14 from coming off from the through holes 119, the fixing operation must be applied separately after the press-fitting, so that the working efficiency is degraded and also the structure tends to become complicated. Further, the development of the waterproof connector is forwarded as the means for simplifying the above connecting operation. However, often such connector is complicated in structure to cause a higher cost.

SUMMARY OF THE INVENTION

The present invention is made in light of such circumstances. It is an object of the present invention to provide a structure and a method capable of assuring the high shield performance in connected portions between a shield cable and an electronic unit with a simple structure.

Further, it is another object of the present invention to achieve effectively a waterproof connection between a plurality of wires and an electronic unit with a simple structure.

Means for Solving the Problems

As the means for solving the above subjects, the present invention provides an electronic unit and a shield cable connecting structure for connecting wires of a shield cable, in which a plurality of wires are covered with a shield lacing, to circuits in an electronic unit, which comprises terminal tools fixed to end portions of the wires and connected to circuits of the electronic unit; a unit housing at least an outer surface of which is formed of metal, and which houses the circuits of the electronic unit therein and which has through portions through which the end portions of the wires are passed; and a metal shield case fixed to an end portion of the shield lacing to be conductive with the shield lacing, and fixed to the outer surface of the unit housing while covering the wires that are passed through the through portions; wherein the shield case and the shield lacing as well as the outer surface of the housing are grounded in a situation that the shield case is fixed to the outer surface of the housing.

According to this structure, since the connected portions between the wires and the unit housing are covered with the shield case, the high shielding performance can be assured by forming successively a series of shield structures from the shield lacing to the unit housing. Also, since the shield case can be brought into the grounded state only by fixing the shield case to the outer surface of the unit housing, the operation becomes simple.

In this structure, it is preferable that the wire holders which are installed in the shield case to fix relative positions of the wires in the shield case to positions that correspond to relative positions of the through holes in the unit housing should be further comprised. If the relative positions of the wires are fixed by the wire holders, the operation of inserting respective wires into the through portions of the unit housing can be facilitated.

In addition, in the structure in which the waterproof plugs that are interposed between outer peripheral surfaces of the wires and inner peripheral surfaces of the through portions to prevent entering of a moisture are fitted to respective wires, the waterproof plugs can be fixed to the wires by a simple operation if the wire holders sandwich collectively these waterproof plugs from outsides and also respective waterproof plugs are fixed to the waterproof plugs by this sandwich.

Also, the present invention provides the electronic unit and a shield cable connecting method of connecting wires of a shield cable, in which a plurality of wires are covered with a shield lacing, to circuits in an electronic unit, which comprises a step of fixing terminal tools to end portions of the wires while retreating an end portion of the shield lacing from end portions of the wires; a step of fixing a metal shield case to the end portion of the shield lacing; a step of passing the end portions of the wires through through portions provided in a unit housing at least an outer surface of which is formed of metal and which houses the circuits of the electronic unit therein; a step of connecting the terminal tools, that are provided to the end portions of the wires passed through the through portions, to circuits of the electronic unit; and a step of fixing the shield case, that is fixed to the end portion of the shield lacing, to the outer surface of the unit housing so as to bring the shield case into a state that the shield case and the outer surface of the housing are grounded.

According to this method, the terminal tools are fixed to the end portions of the wires in the situation that the wires are exposed by retreating the end portion of the shield lacing once, and then the shield case is fixed to the outer surface of the unit housing to cover the wires with the shield case in the situation that the shield case is fixed to the end portion of the shield lacing. Therefore, the connecting structure having the excellent shielding performance can be constructed by a simple operation without the removal of the shield lacing As a means for solving the above subjects, the present invention provides an electronic unit and wires waterproof-connecting structure for connecting a plurality of wires to an electronic unit circuit installed in a vehicle in a waterproof condition, which comprises a unit housing for housing circuits of the electronic unit and having through holes through which end portions of respective wires are passed; waterproof plugs fitted to the wires respectively such that the waterproof plugs are interposed between outer peripheral surfaces of the wires and inner peripheral surfaces of the through holes to prevent entering of a moisture into the unit housing; and a coupling member for coupling these waterproof plugs so as to fix relative positions of the waterproof plugs to positions that correspond to relative positions of the through holes in the unit housing; wherein the waterproof plugs are fitted into the through holes while inserting respective wires into the through holes in a situation that the waterproof plugs are coupled mutually by the coupling member, and the coupling member is fixed to an outer surface of the unit housing.

Also, the present invention provides an electronic unit and wires waterproof-connecting method of connecting a plurality of wires to an electronic unit circuit installed in a vehicle in a waterproof condition, which comprises the steps of fixing relative positions of waterproof plugs to positions that correspond to relative positions of the through holes, that are provided in a unit housing which houses circuits of the electronic unit, by coupling mutually the waterproof plugs, that are fitted to the wires respectively, via the coupling member; fitting the waterproof plugs into the through holes while passing end portions of respective wires through the through holes under above condition; and fixing the coupling member to an outer surface of the unit housing.

According to the above structure and method, since the waterproof plugs fitted to respective wires are coupled by the coupling member (e.g., respective waterproof plugs are held commonly by the common coupling member), the fitting operation of respective waterproof plugs into the through holes in the unit housing can be carried out in the gross with maintaining this coupled state. In addition, the disconnection prevention of the waterproof plugs from the through holes can be collectively attained only by fixing the coupling member to the outer surface of the unit housing together with the fitting operation, and the waterproof structure can be constructed effectively with a simple structure.

It is preferable that, if the influence of the noise upon respective wires or the influence of the noise of the wires upon the outside must be taken into consideration, the shield cable in which the plurality of wires are covered with conductive shield member should be employed. In this case, as the means for grounding the shield member, for example, the terminal tool and the waterproof plug may be installed onto the drain line that is extended from the shield member in the same way as respective wires, then the waterproof plug as well as other waterproof plugs may be fitted into the through hole of the unit housing while holding it by the coupling member, and then the terminal tool may be connected to the earth circuit of the electronic unit. In this case, if the coupling member can be fixed to the unit housing by providing the bolt through holes in the coupling member and fixing the bolts to the unit housing side in the condition that the metal bolts are passed through the bolt through holes and also the shield member can be grounded via the bolts and the unit housing, the shield member can be grounded (i.e., the shield structure can be constructed) without the terminal tools and the waterproof plugs by utilizing the bolts and the unit housing per se as the connecting members.

In order to connect electrically the shield member and the metal bolts, for example, the drain line extended from the shield member may be directly connected to the bolt. In this case, if the shield member can be fixed to the coupling member by connecting the fitting tools having the bolt through holes to the shield member and fixing the bolts to the unit housing side in the state that the metal bolts are passed through these bolt through holes and the bolt through holes of the coupling member and also the shield member can be grounded via the fitting tools, the bolts, and the unit housing, the shield member can be fixed to the coupling member and the unit housing by the bolts and also the electrical connection between the bolts and the shield member can be accomplished via the fitting tools. Thus, the operation efficiency can be further enhanced. Also, since the exposed length of the wires (the length of the portion of the wire that is not covered with the shield member; the length L in FIG. 19) can be very reduced, the shielding performance can be improved.

DETAILED DESCRIPTION OF THE PREFERRED EMBODIMENTS

Embodiments of the Invention

First Embodiment

Figure 9:
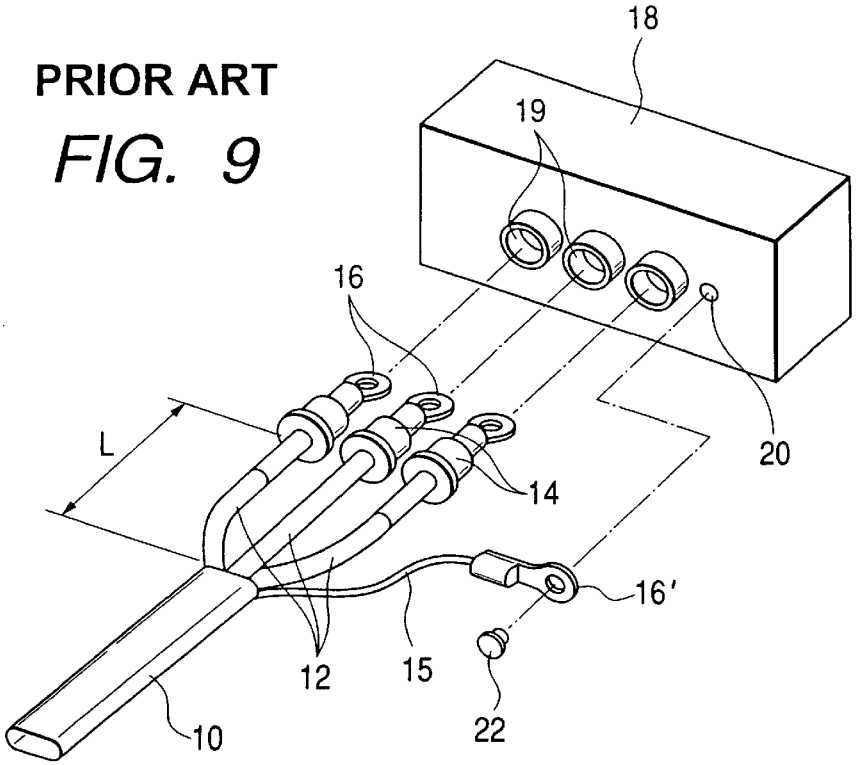
PRIOR ART FIG. 9
FIG. 9 is a perspective view showing an example of a connection structure between the shield cable and the electronic unit in the prior art.

A first embodiment of the present invention will be explained with reference to FIGS. 1A, 1B, and 1C hereinafter. In this case, same reference symbols are affixed to elements that are equivalent to the constituent elements shown in FIG. 9 and FIG. 10, and their explanation will be omitted.

A method of connecting the shield cable and the electronic unit according to this embodiment will be given as follows.

1) First, the shield cable in which a sufficient clearance is assured between a plurality of wires and the shield lacing 10 is fabricated. In order to fabricate such loose shield cable, for example, the shield lacing 10 may be formed around a group of wires that is constructed by bundling a plurality of wires 12 and dummy wires together, and then the dummy wires may be pulled out. According to this method, the clearance can be formed in an interior of the shield lacing 10 by the volume of the dummy wires. This clearance is prepared to make easy the subsequent 2) step.

Figure 10:
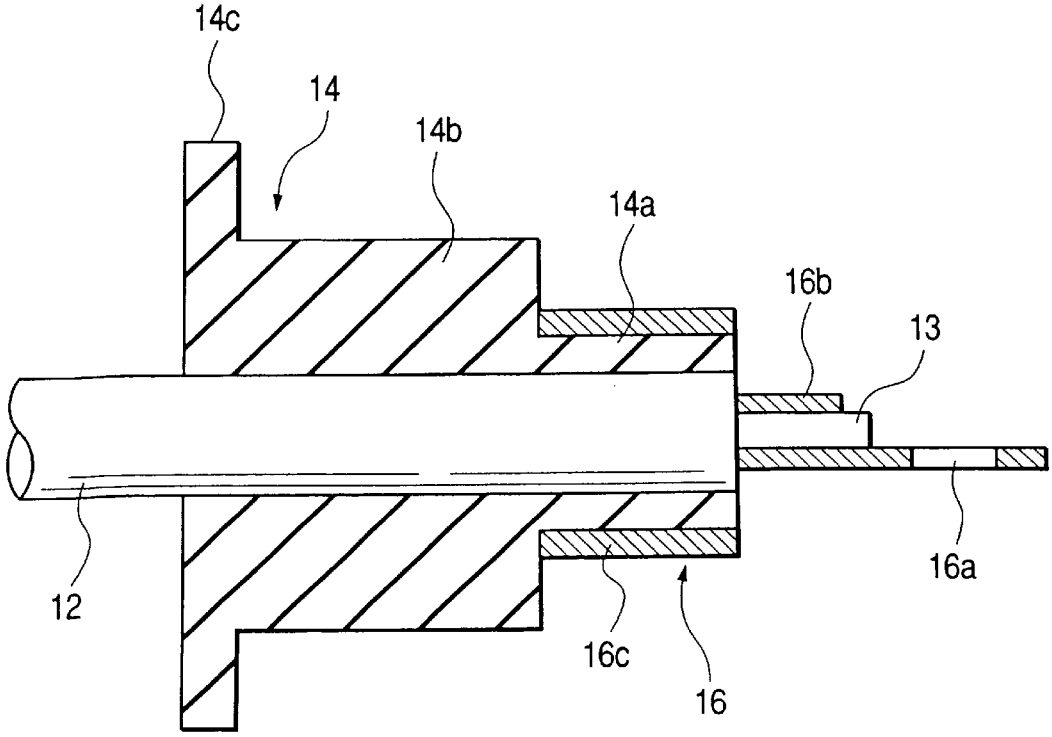
PRIOR ART FIG. 10
FIG. 10 is a sectional view showing an example of a structure for fixing the waterproof plugs and the terminal tools to the end portions of the wires in the shield cable.

2) The end portions of respective wires 12 are exposed by retreating backward end portions of the shield lacing 10 to the position that is in the back of the end portions of respective wires 12. Then, the internal conductors 13 shown in FIG. 10 are exposed by stripping off the coating from the end portions of the wires 12, and then the cylindrical waterproof plugs 14 made of the rubber, etc. shown in the same figure are fitted to the immediately rear position from the outside.

3) Terminal tools 16 are fixed to the end portions of respective wires 12. As this terminal tool 16, as shown in FIG. 10, the tool having a ring-like top end portion in which the through hole 16*a* is formed, a conductor barrel portion 16*b* formed on the rear side of the top end portion, and an insulation barrel portion 16*c* formed on the rear side of the conductor barrel portion 16*b* is employed. The conductor barrel portions 16*b* are press-fitted around the internal conductors 13, and also the insulation barrel portions 16*c* are press-fitted around the press-fitting portions 14*a* of the waterproof plugs 14.

Figure 1A:
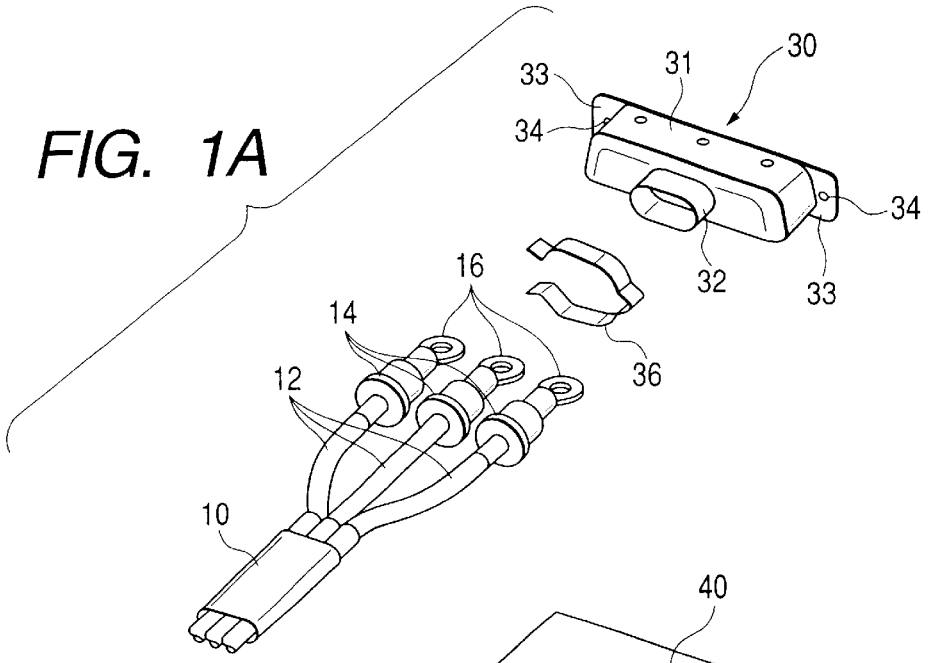
FIG. 1A is a perspective view showing the state that terminal tools are fixed to end portions of respective wires in a first embodiment of the present invention.

4) A metal shield case 30 as shown in FIG. 1A is fixed to the end portion of the shield lacing 10. This shield case 30 has integrally a main body portion 31 having a shape that is opened widely in one direction and covers the end portions of respective wires 12, and a restricted portion 32 that is opened to have an area smaller than the opening on the opposite side to the opening. Ear portions 33 that are protruded outwardly are formed on right and left sides of the main body portion 31 respectively, and vis through holes 34 are formed in respective ear portions 33.

The wires 12 are inserted into the shield case 30 from the restricted portion 32 side, and the end portion of the shield lacing 10 is covered on the outside of the restricted portion 32 of the shield case 30. Then, the shield lacing 10 is fixed to the restricted portion 32 by putting a caulking tool 36 having an almost C-shaped cross section (an almost O-shaped cross section may be employed) on the end portion of the shield lacing 10 and then caulking it, and thus both are brought into the state that they can be grounded (the state in FIG. 1C). The particular means for fixing the shield lacing 10 to the shield case 30 is not required, and the deposition, etc. may be employed as the case may be.

Figure 1B:
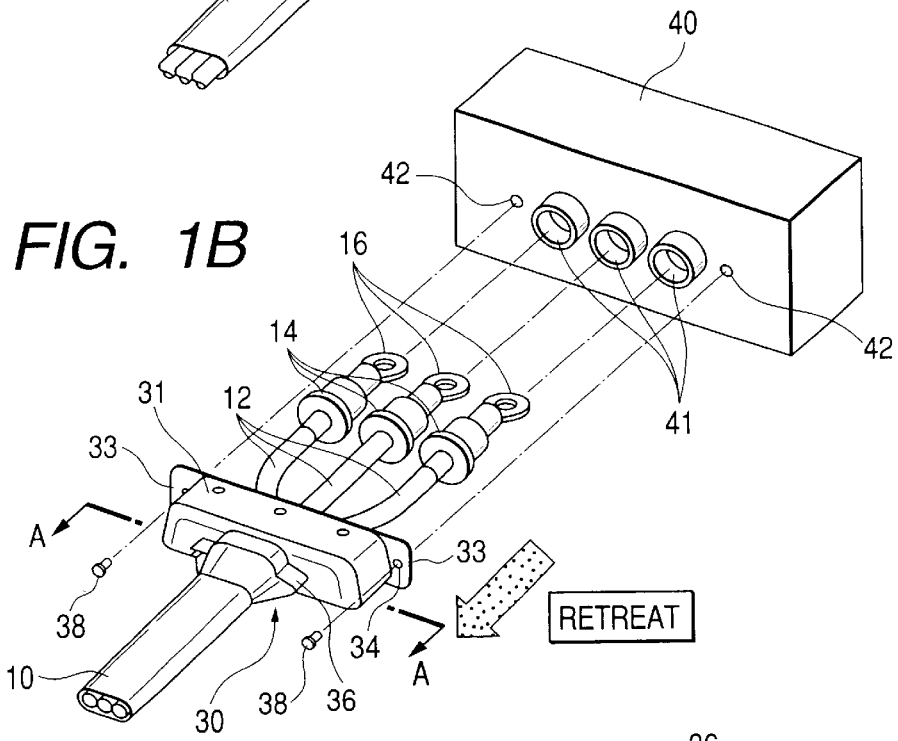
FIG. 1B is a perspective view showing the state a shield case is fixed to an end portion of a shield lacing to cover the wires.
Figure 1C:
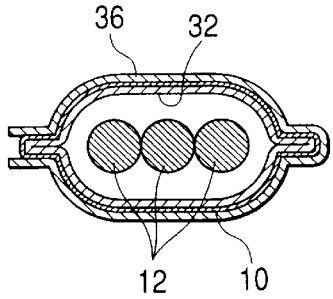
FIG. 1C is a sectional view taken along an A-A line in FIG. 1B.
Figure 2:
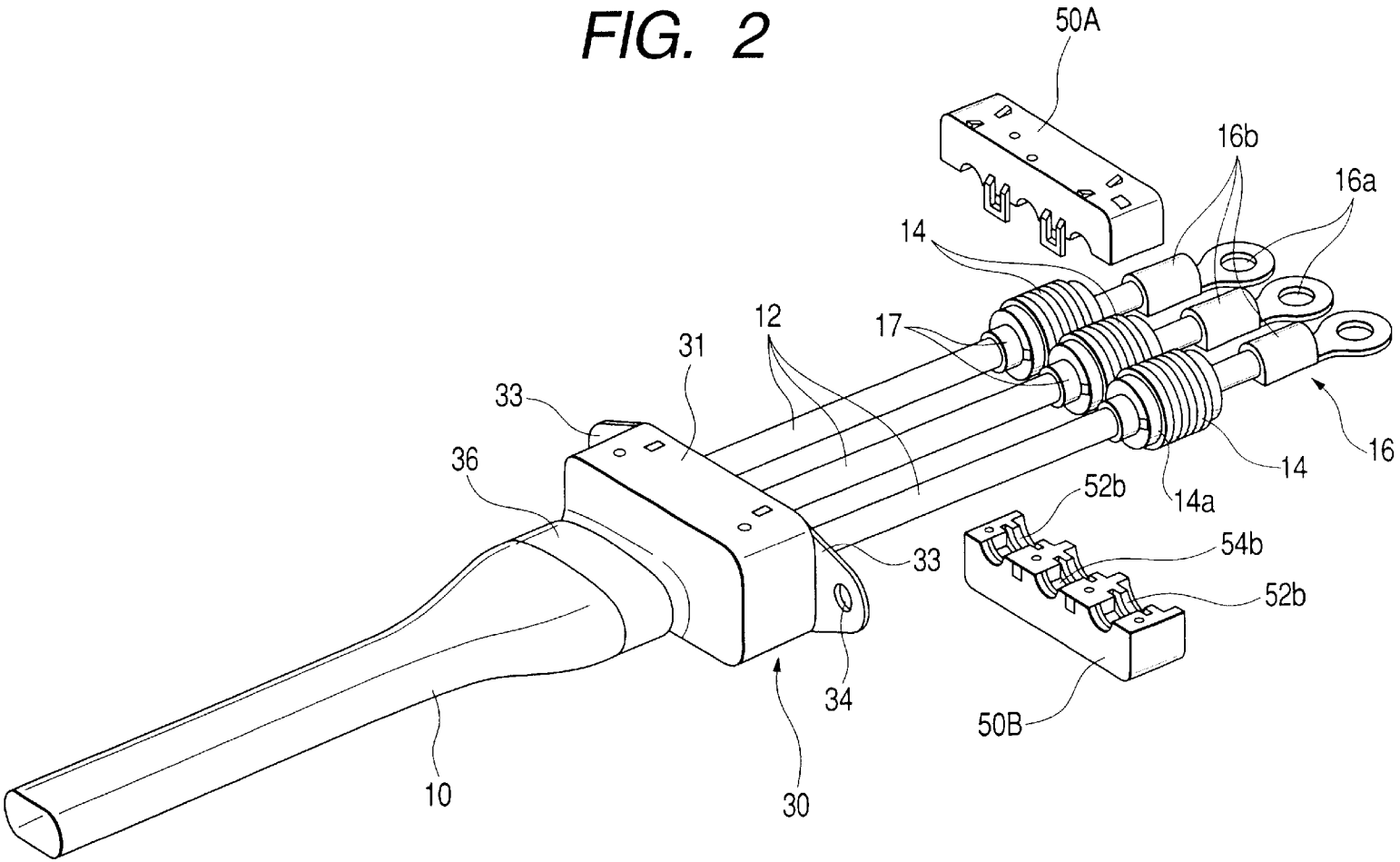
FIG. 2 is a perspective view showing the state before a wire holder is fitted to waterproof plugs of respective wires in a second embodiment of the present invention.
Figure 3:
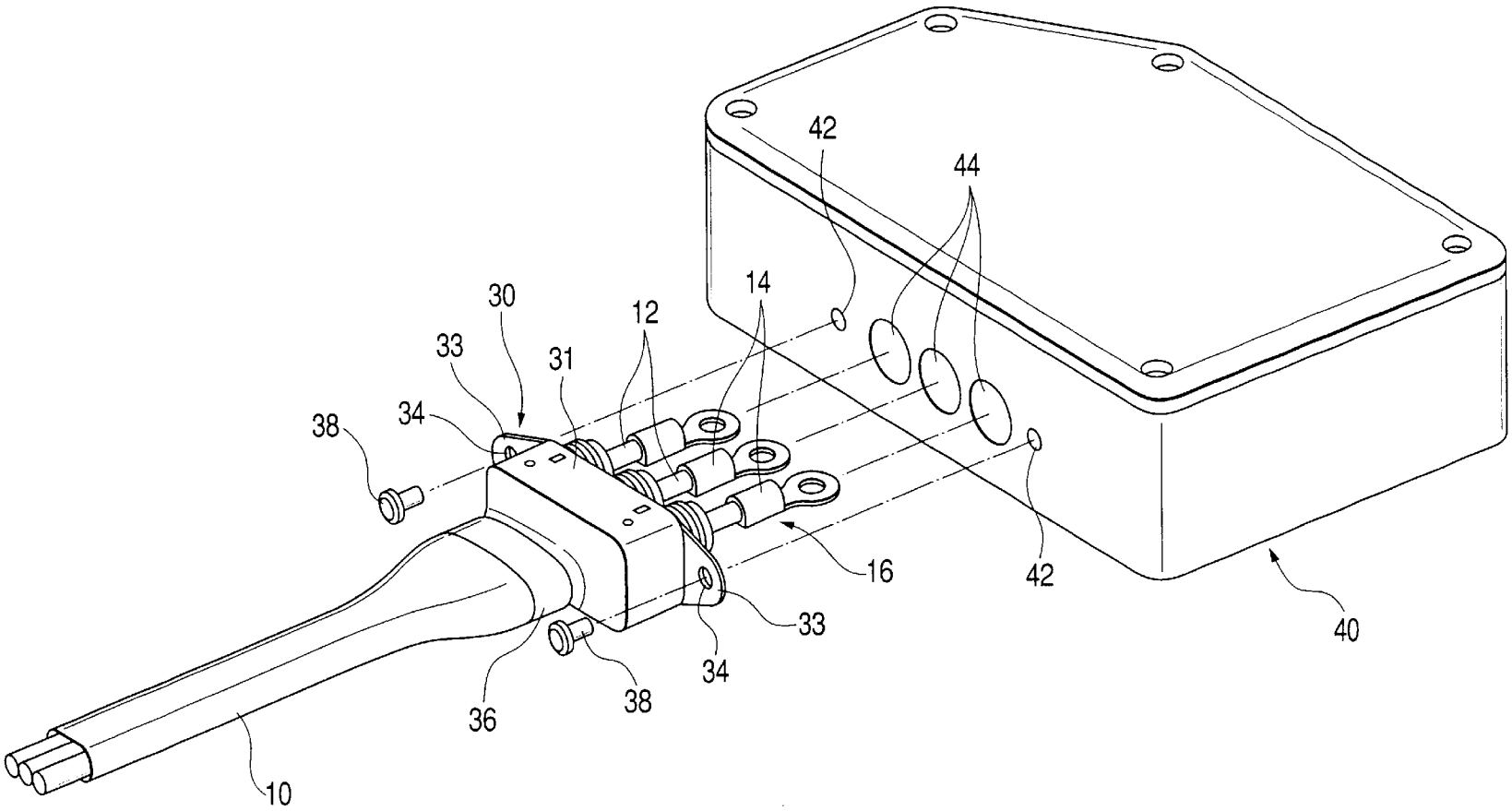
FIG. 3 is a perspective view showing the state before respective wires are passed through through holes of an electronic unit in the second embodiment of the present invention.

5) As shown in FIG. 1B, cylindrical through hole portions 41 are formed in the metal unit housing 40, that houses circuits of the electronic unit, to pass through the unit housing 40. Then, the end portions of respective wires 12 (i.e., the terminal tools 16) are inserted into these through hole portions 41 from the outside, and then the waterproof plugs 14 are press-fitted into the through hole portions 41, whereby the waterproof structure can be constructed.

6) The terminal tools 16 of respective wires 12 that enter into the unit housing 40 via the through hole portions 41 are connected to the electronic circuit housed in the unit housing 40.

7) The ear portions 33 are brought into contact with the outer surface of the unit housing 40 by inserting vises 38 into the vis through holes 34 of the ear portions 33 of the shield case 30, that is fixed to the end portion of the shield lacing 10, from the outside and screwing them into screwed holes 42 provided to the unit housing 40, and then fixed thereto. Accordingly, the connected portions between respective wires 12 and the unit housing 40 can be covered with the shield case 30 from the outside, and the shield case 30 and the shield lacing 10 as well as the unit housing 40 can be grounded collectively by grounding the unit housing 40. According to this grounding, a series of shield structure that extends from the shield lacing 10 to the unit housing 40 via the shield case 30 can be constructed, and also the high shielding performance can be assured at the connected portions.

Second Embodiment

A second embodiment of the present invention will be shown in FIGS. 2 to 6 hereunder.

In this embodiment, the cylindrical waterproof plugs 14 are fitted onto respective wires 12 at the position that is slightly later than their end portions, and the terminal tools 16 are directly fixed to the end portions of respective wires 12 at the position that is the front side rather than the waterproof plugs 14. At that time, as shown in figures, the insulation barrel portions 16*c* of the terminal tools 16 may be press-fitted to the insulating coating portions of the wires 12. Also, a number of peripheral grooves are formed on the surfaces of respective waterproof plugs 14 to form the unevenness, and a peripheral groove 14*d* is formed at the rear ends of the waterproof plugs 14. In addition, the ring-like waterproof plug fixing tools 17 are arranged at the back of the waterproof plugs 14 and are fixed to the peripheries of the wires 12.

Figure 5:
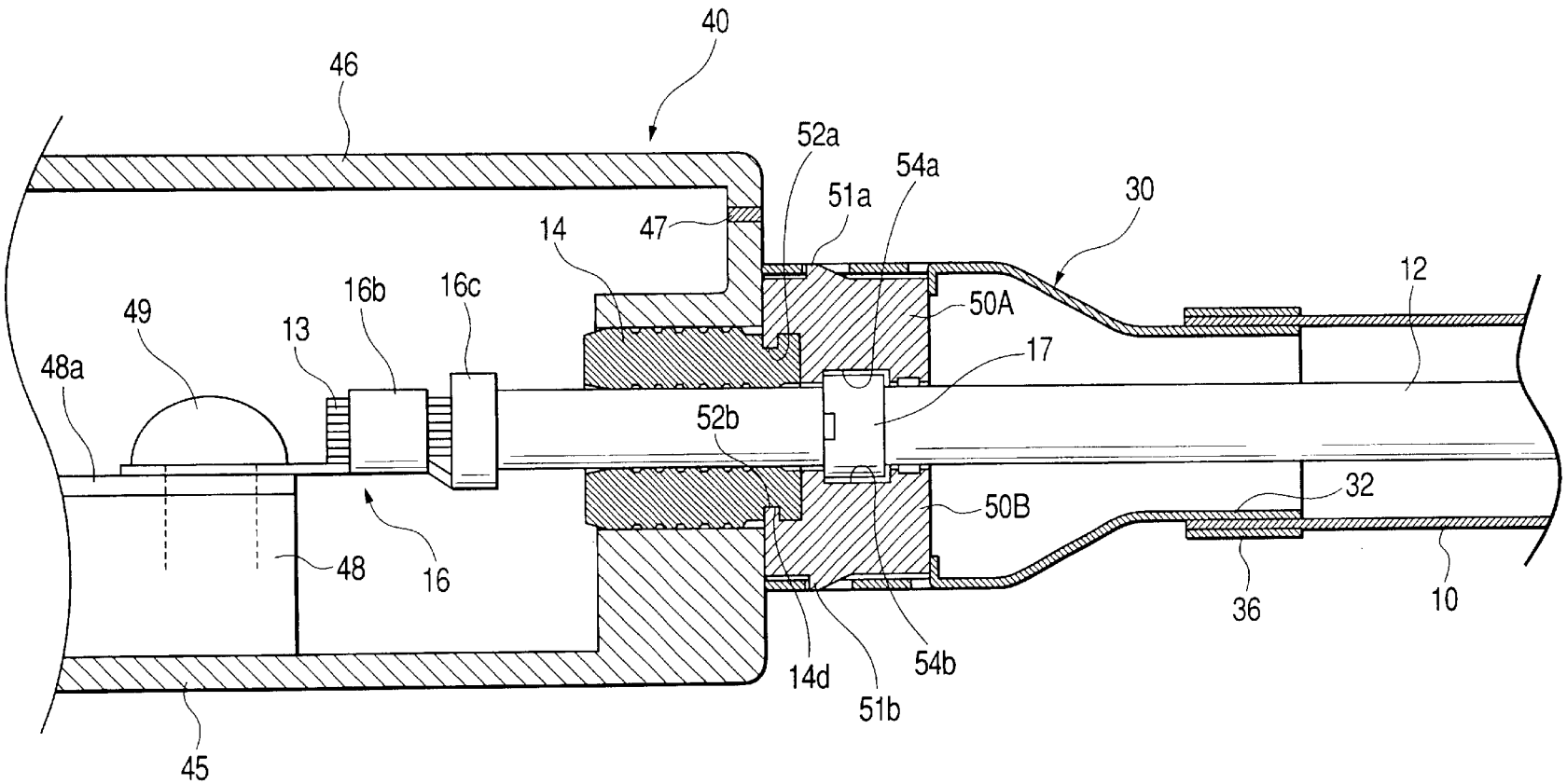
FIG. 5 is a sectional view taken along a B—B line in FIG. 4.

Then, an upper half holder 50A and a lower half holder 50B are coupled together to put the waterproof plug 14 and the fixing tool 17 between them, whereby a wire holder is constructed as a whole. As shown in FIG. 5, inwardly-projected stripes 52*a*, 52*b*, that are fitted to the peripheral grooves 14*d* of the waterproof plugs 14, and concave grooves 54*a*, 54*b*, that are fitted to the fixing tool 17, are formed on inner peripheral surfaces of the upper holder 50A and the lower holder 50B respectively. If both the upper holder 50A and the lower holder 50B are coupled together in the state that respective fittings are carried out in this manner, relative positions of the wires 12 can be fixed mutually and also relative positions between the fixing tools 17 fixed to the wires 12 and the waterproof plugs 14 can be fixed. In other words, the waterproof plugs 14 can be fixed to the wires 12 with the intervention of the upper holder 50A and the lower holder 50B and the fixing tools 17.

Figure 6A:
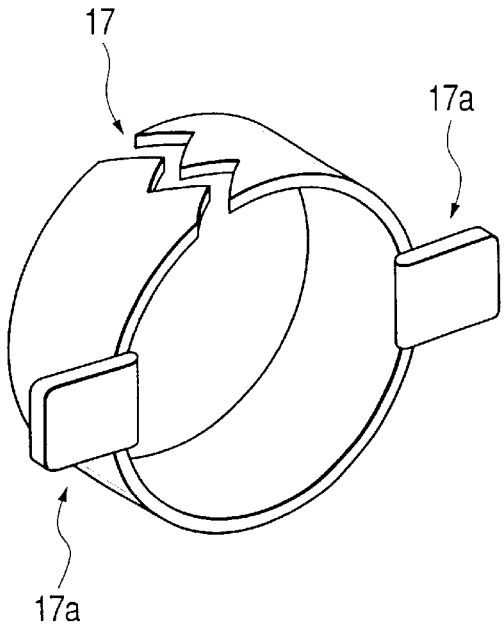
FIG. 6A is a perspective view showing a preferable example of a fitting tool employed in the second embodiment of the present invention.
Figure 6B:
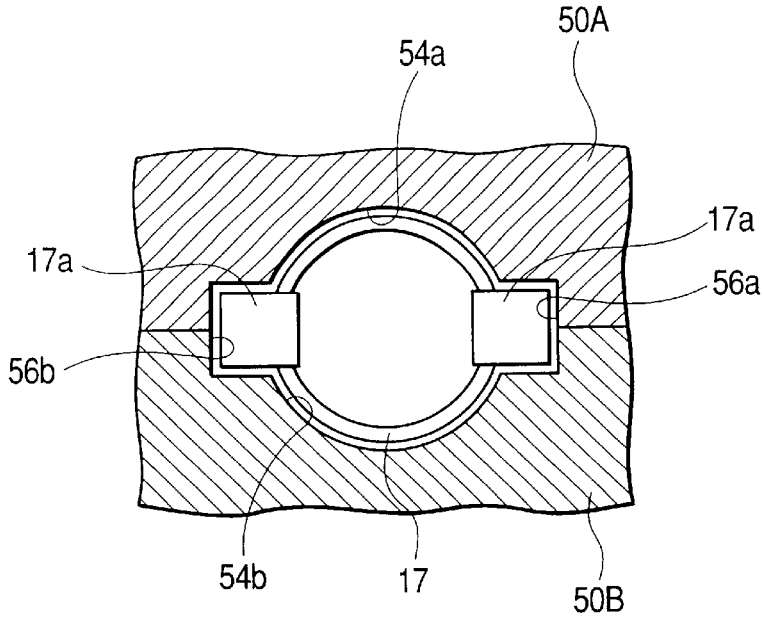
FIG. 6B is a sectional view showing the fitted state of the fitting tool.

In this case, it is preferable that the upper holder 50A and the lower holder 50B should be formed of insulating material such as synthetic resin, etc. If one or plural ear portions 17*a* are projected outward from the ring-like main body portion of the fixing tool 17, as shown in FIG. 6A, for example, and then concave portions 56*a*, 56*b* for sandwiching the ear portions 17*a* are formed on the upper holder 50A and the lower holder 50B respectively, the rotation of the wires 12 can be restricted by sandwiching the ear portions 17*a* by the concave portions 56*a*, 56*b*. Therefore, the through hole 16*a* of the terminal tools 16 fixed to the end portions of the wires 12 can be held in the upward state, so that the operation of connecting the terminal tools 16 and the circuits in the electronic unit can be facilitated. If the fixing tools 17 irrespective to the ear portions 17*a* are formed to have a shape different from a circular shape and also the wire holders (the upper holder 50A and the lower holder 50B in this example) are constructed to restrict such fixing tools 17, this advantage can also be achieved.

In place of the employment of such fixing tools 17, the waterproof plugs 14 can be fixed to the wires 12 while sandwiching directly the wires 12 by virtue of the upper holder 50A and the lower holder 50B.

The wire holders are fitted into the main body portions 31 of the shield case 30 while holding the waterproof plugs 14 by virtue of the wire holders 50A, 50B in this manner. At this time, it is more preferable that, for example, as shown in FIG. 5, the holders 50A, 50B should be latched in the shield case 30 by engaging projections 51*a*, 51*b* formed on the surfaces of the holders 50A, 50B with the holes provided to the shield case 30 side, or the like.

If the waterproof plugs 14 are press-fitted into the through holes 44 formed in the unit housing 40 in this state, the operation of press-fitting the waterproof plugs 14 into the through holes 44 can be simplified much more and also the operation of fixing the waterproof plugs 14 to the wires 12 can be very simplified, since the relative positional relationship between the waterproof plugs 14 are fixed previously to the positions, that correspond to the relative positional relationship between the through holes 44, by the wire holders 50A, 50B.

Figure 4:
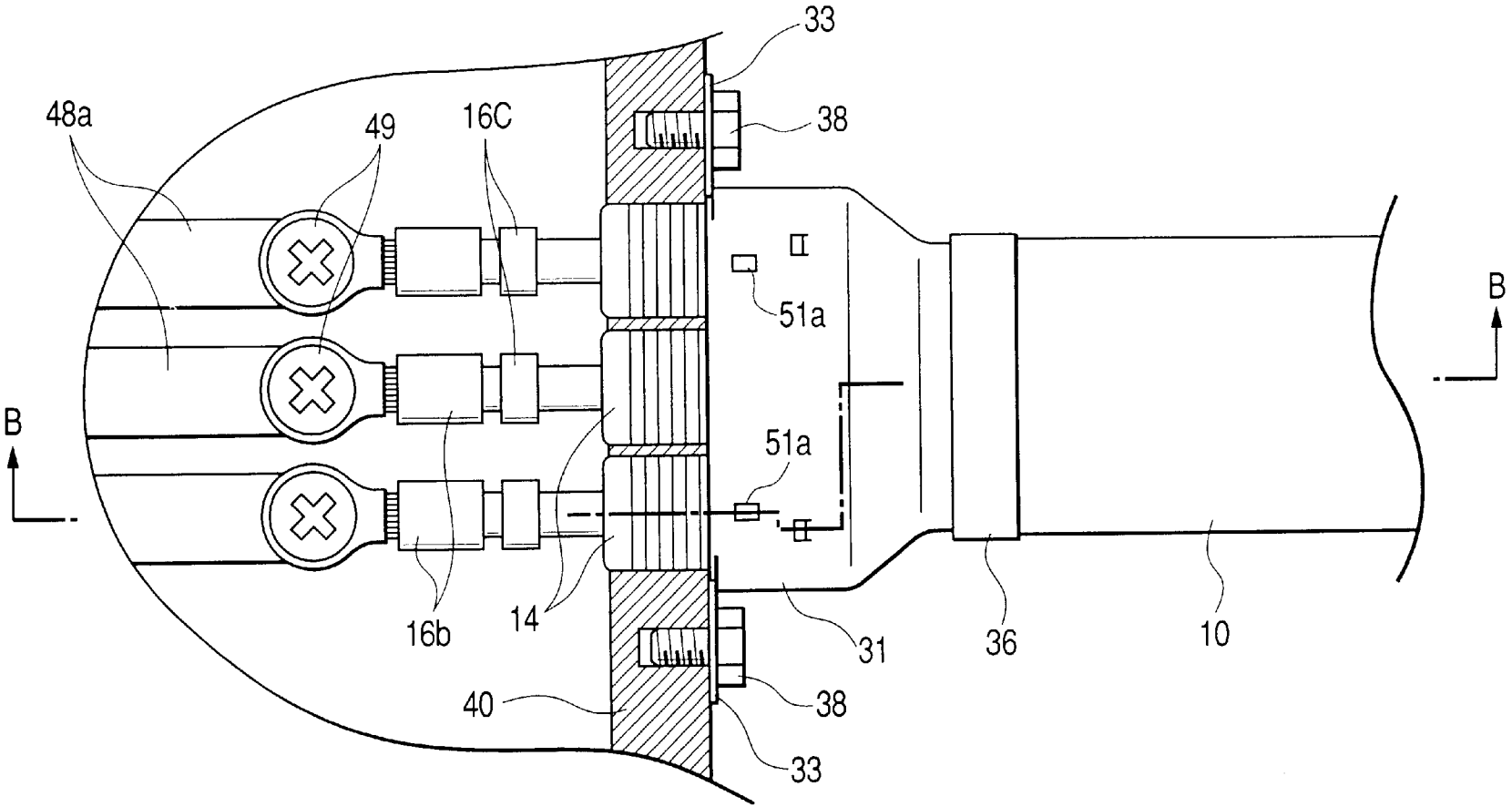
FIG. 4 is a sectional view showing an internal structure of the electronic unit shown in FIG. 3.

An example of the connecting structure in the unit housing 40 is shown in FIGS. 4 and 5. In the illustrated example, the unit housing 40 has a main body 45 opened upwardly and a lid 46 for opening/closing the opening. A circuit constructed by a bus-bar substrate 48 is housed in the main body 45, and the terminal tools 16 are jointed to proper bus bars 48*a* by vises 49 and connected electrically thereto.

This connecting operation can be executed simply in the state that the lid 46 is opened. Then, the bus-bar circuits in the housing can be protected effectively from the moisture on the outside of the housing by closing the lid 46 and then sealing spaces between the lid 46 and the main body 45 of the unit housing with the rubber sealing member 47, etc.

Figure 7:
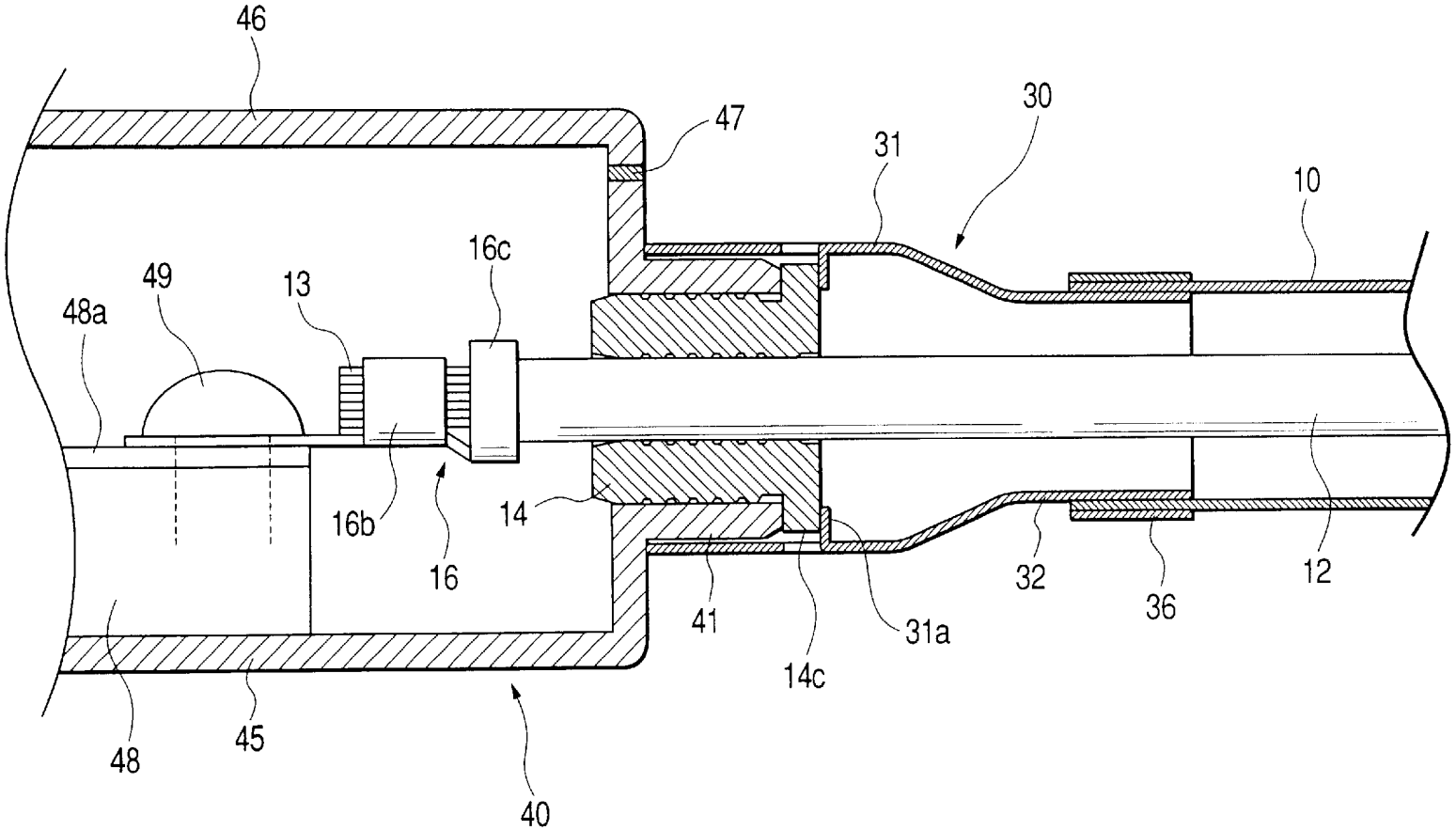
FIG. 7 is a sectional view showing a third embodiment of the present invention.

In this case, even if the wire holders 50A, 50B in the second embodiment are omitted, for example, as a third embodiment, as shown in FIG. 7, the waterproof plug 14 can be fitted firmly to the unit housing 40 by forming a disconnection preventing projection 31*a* on the inside of the main body portion 31 of the shield case 30, then pushing the waterproof plug 14 having the flange portion 14*c* at its rear end into the cylindrical through hole portion 41, and then fixing the shield case 30 to the unit housing 40 such that the flange portion 14*c* of the waterproof plug 14 is held down by the disconnection preventing projection 31*a* from the back side.

In addition, the present invention can show a following embodiment, for example.

Figure 8:
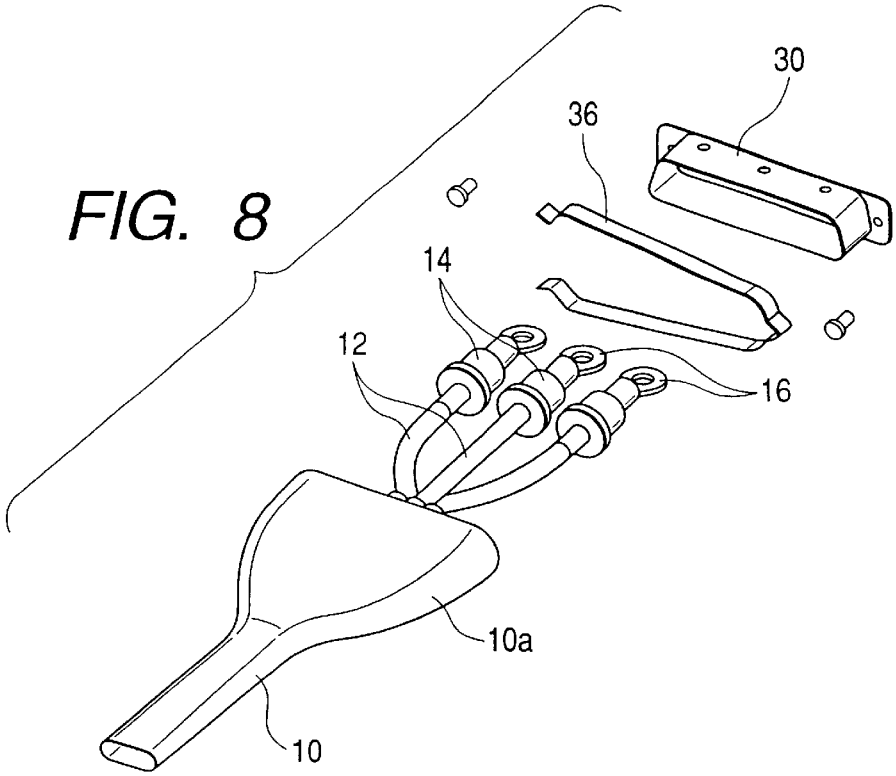
FIG. 8 is a sectional view showing a fourth embodiment of the present invention.

1) In the present invention, the particular shape of the shield case 30 is not requested. For example, as a fourth embodiment, as shown in FIG. 8, the shield case 30 may be formed as a simple cylinder without the restricted portion 32, and then the end portion of the shield lacing 10 that is formed alternatively to widen toward the end may be covered on the main body portion of the shield case 30 as it is, and then the end portion may be fixed to the main body portion by the caulking tool 36, etc.

2) The waterproof plugs 14 can be appropriately omitted in response to the application. If the waterproof plugs 14 are omitted, respective wires 12 may be passed through the through holes of the unit housing 40 as it is.

3) There is no necessity that the overall unit housing 40 should be made of the metal. At least the outer surface of the unit housing 40 may be formed of metal to have the conductivity.

4) In the present invention, the number and the alignment of the wires 12 covered with the shield lacing 10 are not particularly limited. The shape of the shield case 30 may be set appropriately in response to the alignment of the wires 12.

5) In the present invention, the shape of the terminal tools 16 fixed to the end portions of respective wires is not particularly limited. For example, the female terminals that are fitted to the tab terminals formed at the end portions of the bus bars in the electronic unit may be fixed to the end portions of the wires 12.

Fifth Embodiment

A fifth embodiment of the present invention will be explained with reference to FIG. 11 to FIG. 14 hereunder. The same reference symbols are affixed to elements equivalent to the constituent elements shown in FIG. 19 to FIG. 10, and their explanation will be omitted.

Figure 19:
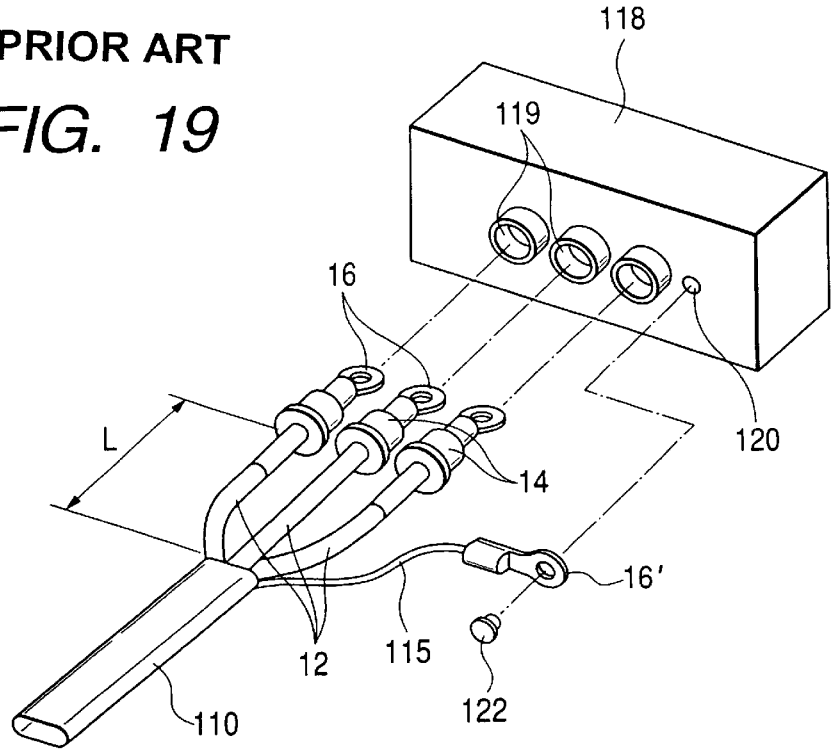
PRIOR ART FIG. 19
FIG. 19 is a perspective view showing an example of a shield cable and electronic unit connecting structure in the prior art.

In this embodiment, like the example shown in FIG. 19 to FIG. 10, respective wires 12 constituting the shield cable and the electronic unit are connected.

Figure 13:
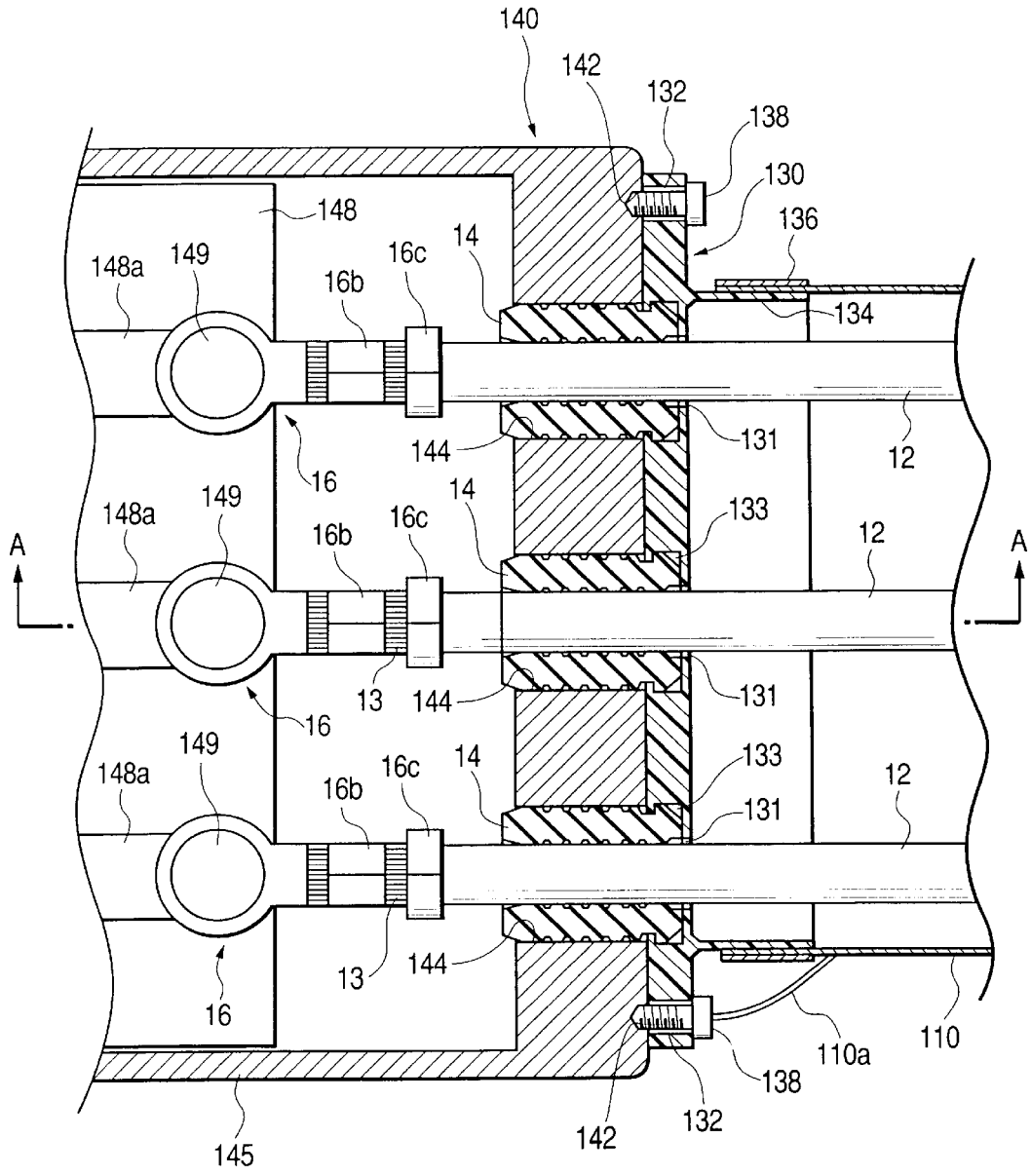
FIG. 13 is a sectioned plan view showing the state that respective wires are connected to circuits in the unit by inserting respective waterproof plugs into through holes of a unit housing.
Figure 14:
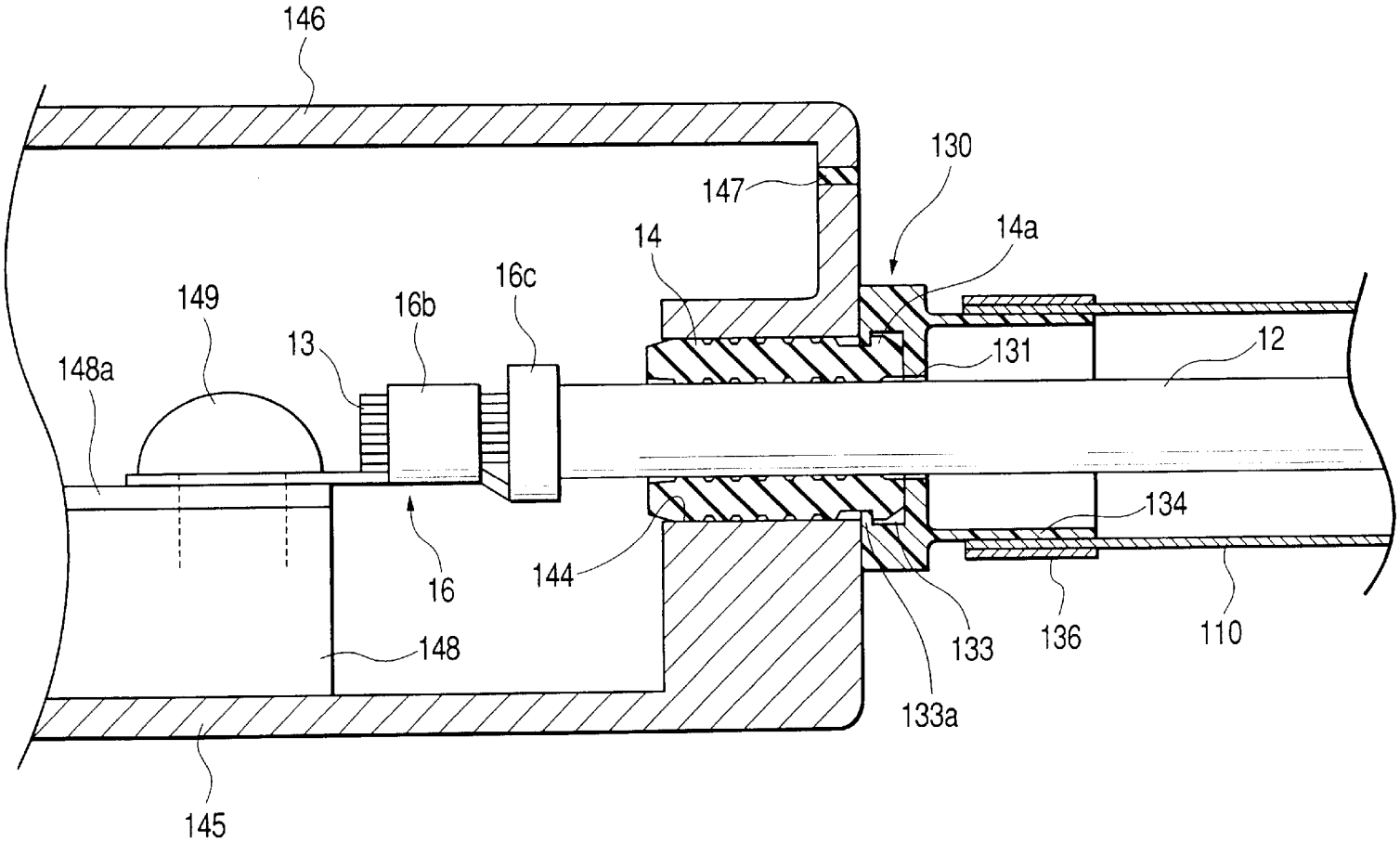
FIG. 14 is a sectional view taken along an A—A line in FIG. 13.

A unit housing 140 is formed of metal and can be grounded by itself. As shown in FIG. 13 and FIG. 14, this unit housing 140 has a main body 145 that is opened upwardly and a lid 146 for opening/closing the opening, and circuits constructed on a bus-bar substrate 148 are installed in the main body 145. Through holes 144 through which respective wires 12 are passed are provided to be aligned laterally on side walls of the main body 145, and screwed hole 142 that are opened outwardly are formed on left and right side portions of the side walls.

Meanwhile, the structure shown herein has a coupling member 130 shown in FIG. 11 to FIG. 14.

This coupling member 130 is formed insulating material such as synthetic resin, etc. like a plate, and has a plurality of wire through holes 131 aligned on a line (as many as the wires 12) and bolt through holes 132 provided on right and left side portions. The positions of the wire through holes 131 and the bolt through holes 132 correspond to the positions of the through holes 144 and the screwed hole 142 in the unit housing 140.

Waterproof-plug fitting holes 133 each having a diameter larger than the wire through hole 131 are formed on the innermost side (the unit housing side) of respective wire through holes 131. A flange hole 133*a* is projected inwardly from the peripheral edge of the waterproof-plug fitting hole 133. Also, a hood 134 having a shape (a longitudinal circular shape in the example shown in figures) to surround the wire through holes 131 from the outside is formed on a surface opposite to the waterproof-plug fitting hole 133.

In contrast, the waterproof plug 14 fitted to the wire 12 is formed cylindrically of the elastic material such as the rubber, etc. A projected stripe 14*a* that projects outwardly in the diameter direction is formed at the rear end of the waterproof plug 14. An outer diameter of this is set substantially identically to an inner diameter of the waterproof-plug fitting holes 133.

Next, an example of a connecting method using this coupling member 130 will be explained hereunder.

1) First, the shield cable having a sufficient clearance between a plurality of the wires 12 and the shield lacing (shielding member) 110 that covers these wires is fabricated. In order to fabricate such loose shield cable, for example, the shield lacing 110 may be formed around a group of wires that is constructed by bundling a plurality of wires 12 and dummy wires together, and then the dummy wires may be pulled out. According to this method, the clearance can be formed in an interior of the shield lacing 110 by the volume of the dummy wires. This clearance is prepared to make easy the subsequent 2) step.

Figure 11:
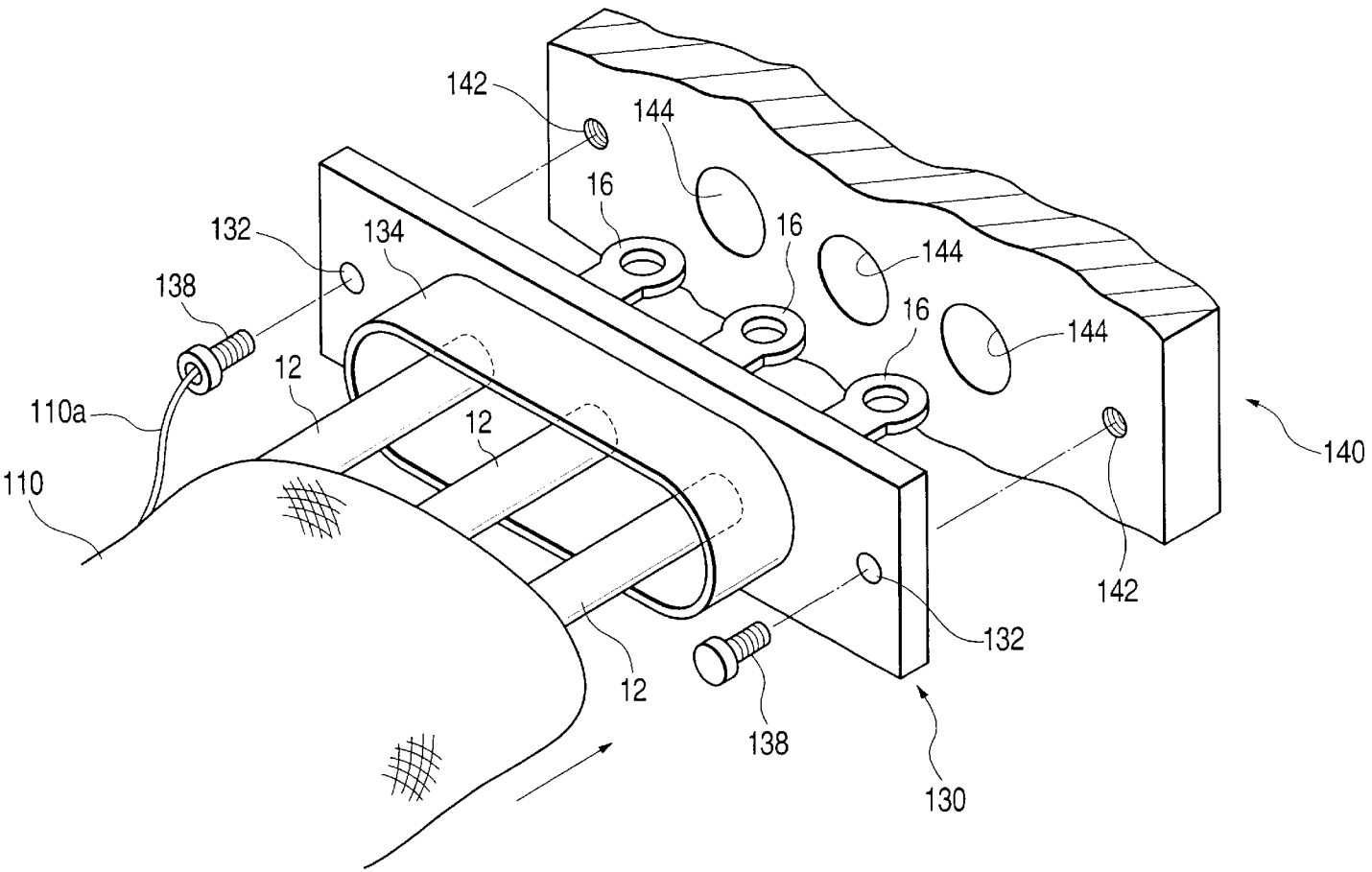
FIG. 11 is a partially-sectioned perspective view showing the state before respective wires of a shield cable are connected to an electronic unit in a fifth embodiment of the present invention.
Figure 12:
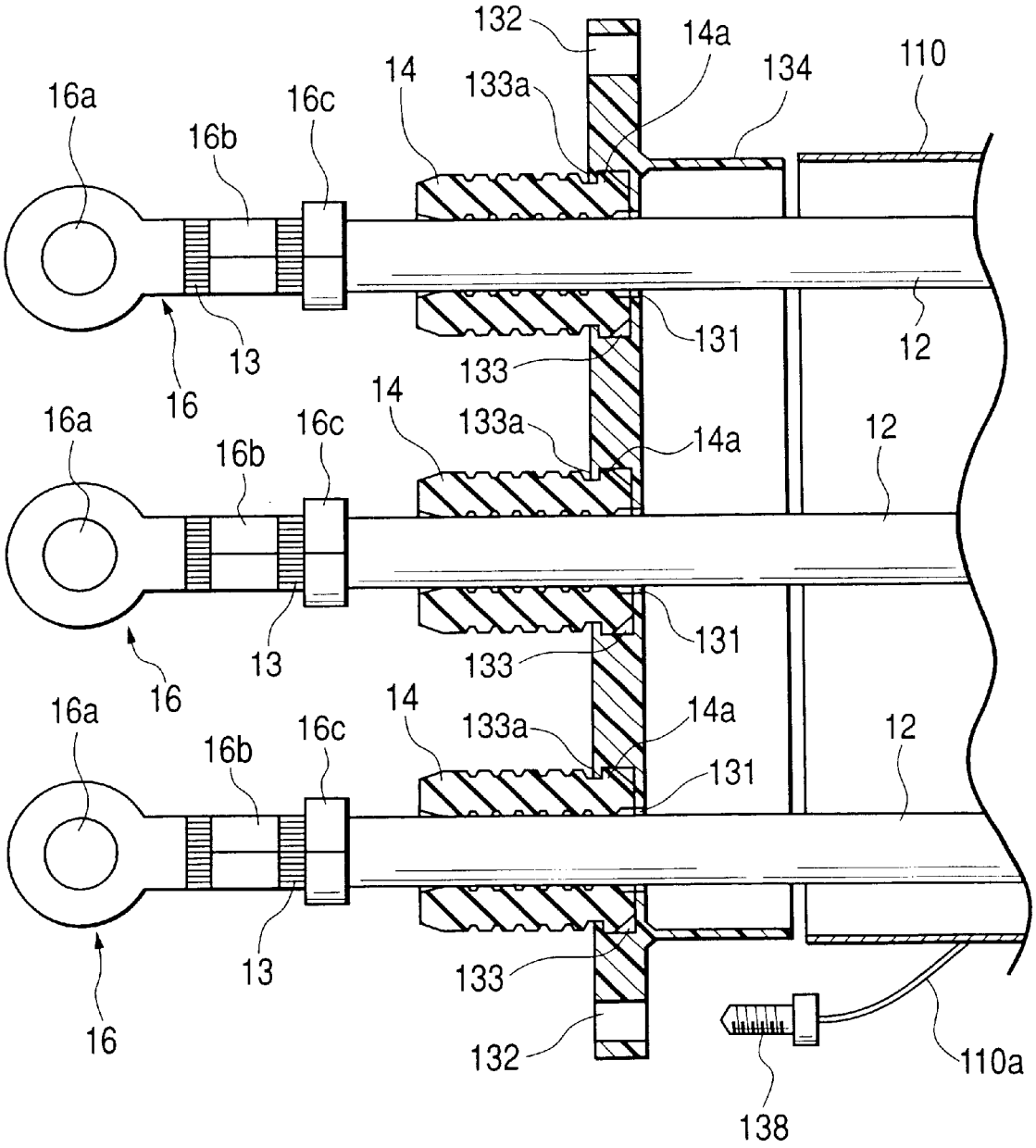
FIG. 12 is a sectioned plan view showing the state that waterproof plugs fitted to respective wires are coupled mutually by coupling members.

2) The end portions of respective wires 12 are exposed by retreating backward end portions of the shield lacing 110 to the position that is in the back of the end portions of respective wires 12. Then, these wires are inserted into the wire through holes 131 of the coupling member 130, as shown in FIG. 11 and FIG. 12, from the opposite side to the waterproof plug fitting holes 133 respectively.

3) The internal conductors 13 are exposed by stripping off the coating from the end portions of the wires 12, and then the cylindrical waterproof plugs 14 made of the rubber, etc. shown in the same figure are fitted to the immediately rear position from the outside.

4) Terminal tools 16 are fixed to the end portions of respective wires 12. As this terminal tool 16, as shown in FIG. 10, the tool having a ring-like top end portion in which the through hole 16*a* is formed, a conductor barrel portion 16*b* formed on the rear side of the top end portion, and an insulation barrel portion 16*c* formed on the rear side of the conductor barrel portion 16*b* is employed. The conductor barrel portions 16*b* are press-fitted around the internal conductors 13, and also the insulation barrel portions 16*c* are press-fitted around the insulating layers of the wires 12 positioned on the front side of the waterproof plugs 14.

5) Rear end portions of the waterproof plugs 14 are press-fitted into the waterproof plug fitting holes 133 from the inside of the flange portions 133*a*. Accordingly, since the projected stripes 14*a* provided to the rear end portion are latched by the flange portions 133*a* from the inside of the waterproof plug fitting holes 133, the state that the waterproof plugs 14 are not come off unless the strong force is applied can be brought about. In other words, respective waterproof plugs 14 are held by the common coupling member 130, and the waterproof plugs 14 are coupled mutually by this coupling member 130. According to this coupling, relative positions of the waterproof plugs 14 are fixed to positions that correspond to the relative positions of respective through holes 144 of the unit housing 140 side.

6) The end portions of the wires 12 are passed through the through holes 144 respectively, and the waterproof plugs 14 are fitted into the through holes 144 from the outside. At this time, since the waterproof plugs 14 are held by the coupling member 130 at the positions that correspond to respective through holes 144, the fitting operation of the waterproof plugs 14 can be collectively carried out.

7) Metal bolts 138 are passed through the bolt through holes 132 from the outside and then screwed into screwed hole 142 on the unit housing 140 side. Accordingly, the coupling member 130 can be fixed to the outer surface of the unit housing 140 and the disconnection prevention of the waterproof plugs 14 can be collectively achieved.

8) The terminal tools 16 of respective wires 12 that are inserted into the unit housing 140 via the through holes 144 are connected to the electronic circuit 140 housed in the unit housing 140. More particularly, in the state that the lid 146 of the unit housing 140 is opened, the terminal tools 16 are jointed to proper bus bars 148*a* on the bus-bar substrate 148 housed in the main body 145 by the vises 149 and electrically connected thereto. Then, a space between the lid 146 and the main body 145 of the unit housing 140 is sealed with the sealing member 147, or the like by closing the lid 146. Thus, bus-bar circuits in the housing can be protected effectively from the moisture existing on the outside of the housing.

9) The shield lacing 110 is fixed to the coupling member 130 by covering the end portion of the shield lacing 110 on the hood 134 formed on the coupling member 130 from the outside, then covering the caulking tool 136 (e.g., plate-like tool having the shape formed along the outer shape of the hood 134) shown in FIG. 13 and FIG. 14 on the outer periphery from the outside, and then caulking the caulking tool 136. The particular means for fixing the shield lacing 110 to the coupling member 130 is not required and, for example, the deposition, etc. may be employed as the case may be.

10) The drain line 110*a* extended from the shield lacing 10 is connected electrically to one of bolts 138 by the soldering, or the like. Accordingly, the shield lacing 110 as well as the volts 138 and the unit housing 140 are brought into the state that they can be grounded. The connection between the drain line 110*a* and the bolt 138 may be executed at the stage prior to the fixing of the coupling member 130 as shown in FIG. 11. In this case, if the electrical connection is performed after the tightening of the bolts 138 is completed, such tightening operation can be executed more smoothly.

Sixth Embodiment

Figure 15:
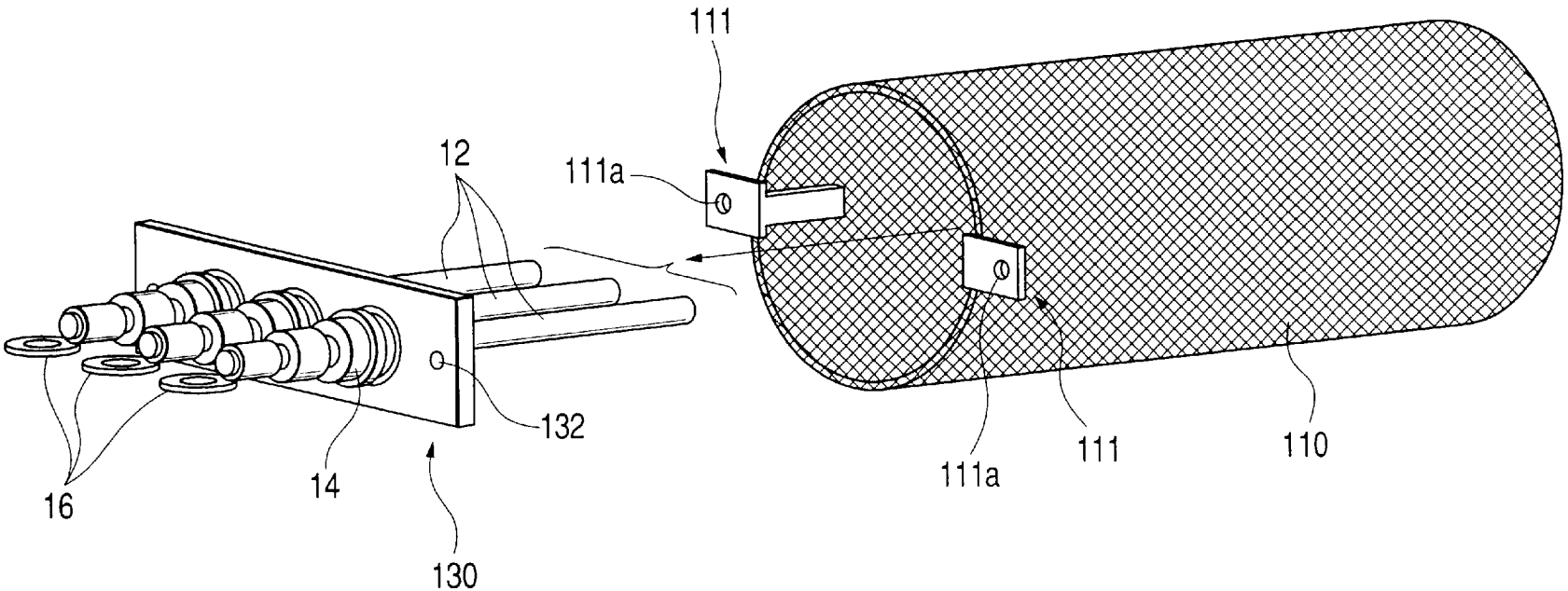
FIG. 15 is an exploded perspective view of a waterproof-connecting structure according to a sixth embodiment of the present invention.
Figure 16A:
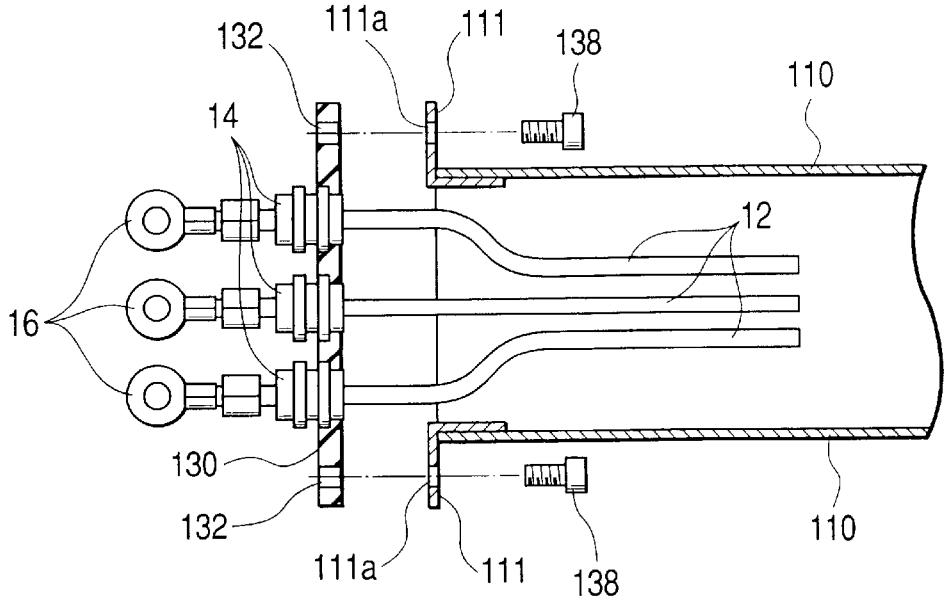
FIG. 16A is an exploded and sectioned plan view of the structure shown in FIG. 15.
Figure 16B:
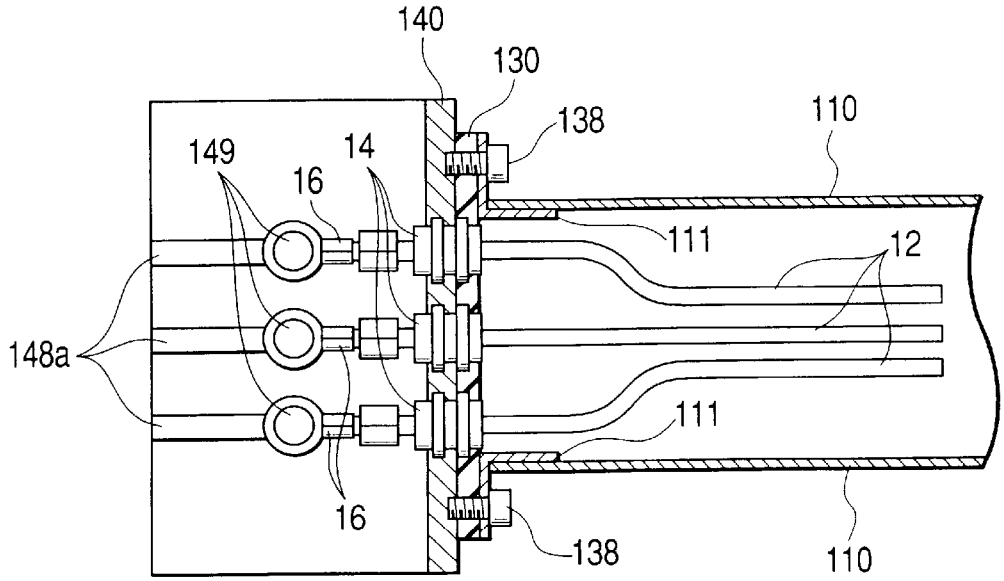
FIG. 16B is an assembled and sectioned plan view of the structure.

A sixth embodiment of the present invention will be shown in FIG. 15 and FIG. 16.

In this embodiment, structures of the shield cable, the coupling member 130 and the unit housing 140 are totally similar to those in the fifth embodiment. Also, above 1) to 6) steps in the connecting method in the fifth embodiment are common.

In this embodiment, prior to the bolt tightening operation in the above 7) step, a pair of right and left fitting tools 111 as shown in FIG. 15 and FIG. 16 are fixed in advance to the end portion of the shield lacing 110 by the welding, etc., and then connected electrically thereto. In this example, the L-shaped tools are employed as the fitting tools 111, and then the fitting tools 111 are fixed such that one sides are fixed to the inner surface of the shield lacing 110 and the other sides are protruded to both outward sides. Also, the bolt through holes 111*a* are provided in the other sides, and then their positions are set such that the bolt through holes 111*a* coincide with the bolt through holes 132 of the coupling member 130.

According to this structure, if the metal bolts 138 are screwed into the screwed holes 142 on the unit housing 140 side in the situation that the bolts 138 are passed through the bolt through holes 111*a* of the fitting tools 111 and the bolt through holes 132 of the coupling member 130, the coupling member 130 and the shield lacing 110 can be fixed to the unit housing 140 together and at the same time the shield lacing 110 can be connected electrically to the metal unit housing 140 via the fitting tools 111 and the metal bolts 138 that contact to the fitting tools 111. That is, it is possible to simply ground the shield lacing 110 via the fitting tools 111, the bolts 138, and the unit housing 140.

Figure 17:
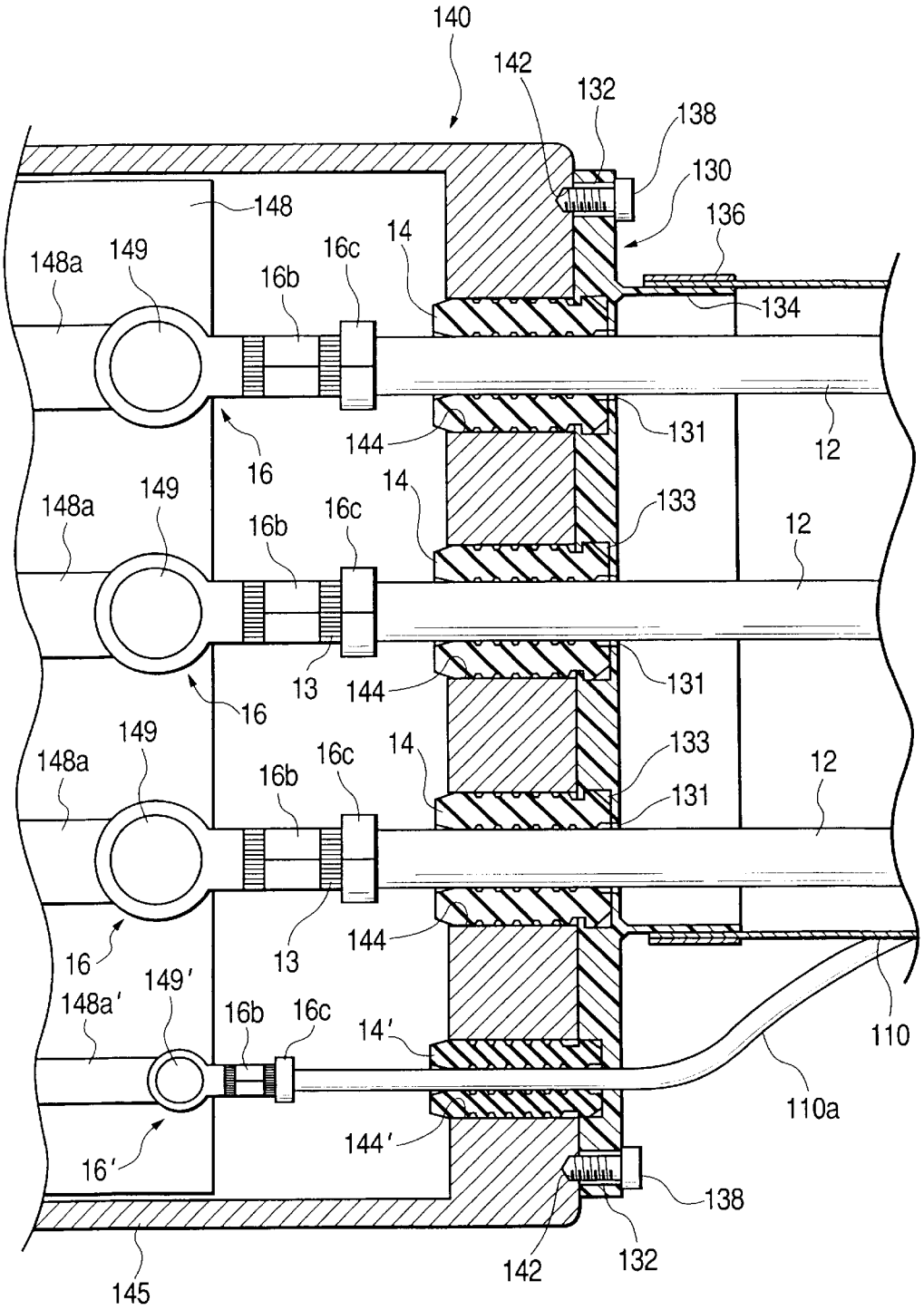
FIG. 17 is a sectioned plan view of a waterproof-connecting structure according to a seventh embodiment of the present invention.

Here, the present invention is not limited to the connection of the shield cable, and may be applied widely to the case where a plurality of wires 12 are connected to the electronic unit in the waterproof condition. Also, in case the present invention is applied to the shield cable, the method of grounding the shield member is not limited to the above method, and the earth connection for the shield member may be achieved by another structure different from the structure employed in the present invention. Also, as a seventh embodiment, as shown in FIG. 17, the terminal tool 16' and the waterproof plug 14' may be fitted to the drain line 110*a* extended from the shield lacing 110 similarly to other wires 12, then this waterproof plug 14' may be inserted into the through hole 144' of the unit housing 140 while holding it as well as other waterproof plugs 14 by the common coupling member 130, and then the terminal tool 16' may be jointed to the earth connection bus bar 148*a*' on the bus-bar substrate 148 by the vis 149', or the like.

In addition, the present invention may be implemented as a following embodiment, for example.

1) In the present invention, the particular structure of the coupling member 130 is not requested and also the structure for holding the waterproof plugs 14 may be set appropriately. For example, the coupling member 130 may be divided into half pieces, and then the half pieces may be jointed together to put the waterproof plug 14 between them respectively. Otherwise, the waterproof plugs 14 may be fixed to the coupling member 130 by the means such as the adhesive, etc. Also, the waterproof plugs 14 may be incorporated previously into the coupling member 130 and then the wires 12 may be passed through respective waterproof plugs 14. In this case, for example, it is possible to form integrally the coupling member 130 and the waterproof plugs 14.

2) In the present invention, the material of the coupling member 130 is not limited. In this case, it is more preferable that the coupling member 130 should be formed of insulating material such as the synthetic resin, or the like.

3) If the shield lacing 110 is grounded via the unit housing 140, there is no necessity that the overall unit housing 140 should always be formed of metal. Merely the outer surface of the unit housing 140 may be formed of the metal having the conductivity.

Figure 18:
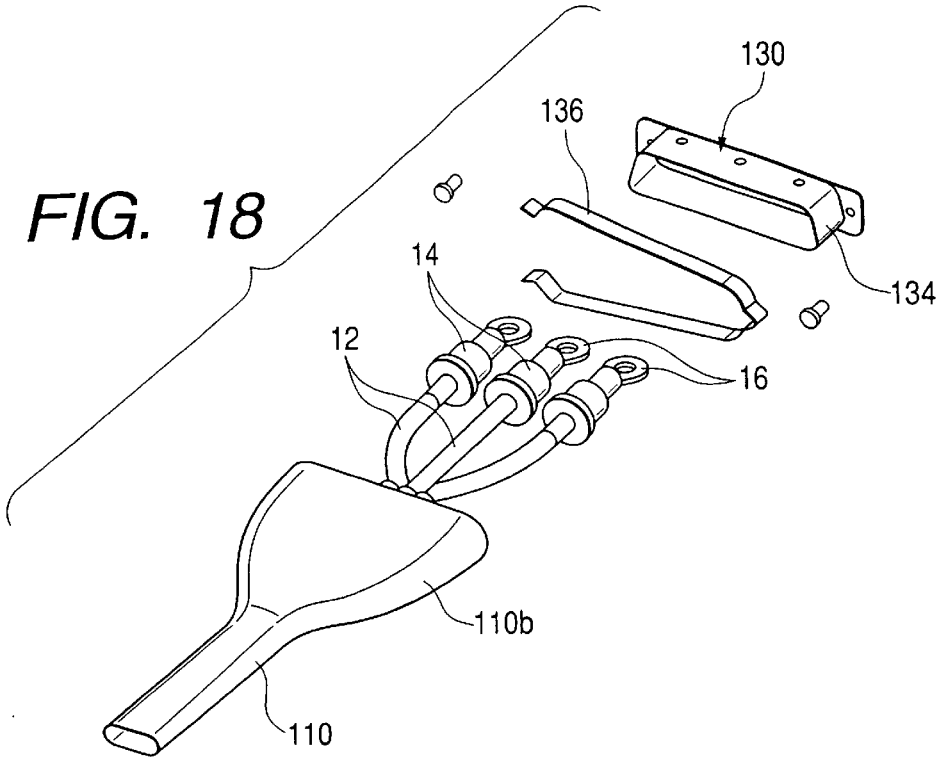
FIG. 18 is a perspective view showing an example in which an end of a shield lacing is expanded to coincide with a shape of the coupling member in the present invention.

4) In the present invention, the number and the alignment of the wires 12 covered with the shield lacing 110 are not particularly limited. The shape of the coupling member 130 may be set appropriately in response to the alignment of the wires 12. Also, even if the shape of the coupling member 130 is formed into the irregular shape, for example, the hood 134 is formed into the very long shape in the lateral direction, as shown in FIG. 18, the shield lacing 110 can be coupled with the coupling member 130 by expanding the end portion 110*b* of the shield lacing 110 to coincide with this shape of the coupling member 130, as shown in FIG. 18.

5) In the present invention, the particular shape of the terminal tool 16' fixed to the end portions of respective wires 12 is not requested. For example, the female terminals, which are fitted into the tab terminals formed on the end portions of the bus bars of the electronic unit, may be fixed to the terminals of the wires 12.

Advantage of the Invention

As described above, according to the present invention, since the shield case is connected/fixed to the end portion of the shield lacing, and then the shield case is fixed to the unit housing while covering the connected portions between respective wires and the unit housing with the shield case, the shield case and the shield lacing as well as the unit housing can be grounded collectively. Therefore, there can be achieved the advantage that the high shield performance can be assured with a simple structure.

As described above, according to the present invention, the waterproof plugs fitted to respective wires are coupled mutually by the coupling member, and then these waterproof plugs are inserted collectively into the through holes on the unit housing side. Therefore, there can be achieved the advantage that the waterproof connection between the electronic unit and a plurality of wires can be achieved effectively with a simple structure.

What is claimed is:

1. An electronic unit and a shield cable connecting structure for connecting wires of a shield cable, in which a plurality of wires are covered with a shield lacing, to circuits in an electronic unit, said connecting structure comprising:

terminal tools fixed to end portions of the wires and connected to circuits of said electronic unit;

a unit housing at least an outer surface of which is formed of metal, and which houses said circuits of said electronic unit therein and which has through portions through which the end portions of the wires are passed; and a metal shield case fixed to an end portion of said shield lacing to be conductive with said shield lacing, and fixed to the outer surface of said unit housing while covering the wires that are passed through the through portions; wherein said shield case and said shield lacing as well as the outer surface of said housing are grounded in a situation that said shield case is fixed to the outer surface of said housing.

2. The electronic unit and the shield cable connecting structure according to claim 1, further comprising:

wire holders installed in said shield case, for fixing relative positions of the wires in said shield case to positions that correspond to relative positions of the through holes in said unit housing.

3. The electronic unit and the shield cable connecting structure according to claim 2, wherein waterproof plugs that are interposed between outer peripheral surfaces of the wires and inner peripheral surfaces of the through portions to prevent entering of a moisture are fitted to respective wires, and said wire holders sandwich collectively said waterproof plugs from outsides to fix said waterproof plugs to a wire side.

4. An electronic unit and a shield cable connecting method of connecting wires of a shield cable, in which a plurality of wires are covered with a shield lacing, to circuits in an electronic unit, said connecting method comprising:

a step of fixing terminal tools to end portions of the wires while retreating an end portion of said shield lacing from end portions of the wires;

a step of fixing a metal shield case to the end portion of said shield lacing;

a step of passing the end portions of the wires through through portions provided in a unit housing at least an outer surface of which is formed of metal and which houses said circuits of said electronic unit therein;

a step of connecting said terminal tools, that are provided to the end portions of the wires passed through the through portions, to circuits of said electronic unit; and a step of fixing said shield case, that is fixed to the end portion of said shield lacing, to the outer surface of said unit housing so as to bring said shield case into a state that said shield case and the outer surface of said housing are grounded.

* * * * *